US009593514B2

(12) United States Patent
Patel

(10) Patent No.: US 9,593,514 B2
(45) Date of Patent: Mar. 14, 2017

(54) SEAMLESS EXTERIOR HANDLE FOR A VEHICLE DOOR

(71) Applicant: Ford Global Technologies, LLC, Dearborn, MI (US)

(72) Inventor: Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 46 days.

(21) Appl. No.: 13/769,662

(22) Filed: Feb. 18, 2013

(65) Prior Publication Data

US 2014/0230329 A1 Aug. 21, 2014

(51) Int. Cl.

| | |
|---|---|
| ***E05B 83/36*** | (2014.01) |
| ***E05B 85/10*** | (2014.01) |
| ***E06B 7/28*** | (2006.01) |
| ***E05B 19/00*** | (2006.01) |
| ***E05B 19/04*** | (2006.01) |
| ***E05B 79/20*** | (2014.01) |
| ***E05B 81/90*** | (2014.01) |
| ***E05B 85/06*** | (2014.01) |
| *E05B 85/16* | (2014.01) |

(52) U.S. Cl.

CPC ..... *E05B 83/36* (2013.01); *E05B 19/0082* (2013.01); *E05B 19/043* (2013.01); *E05B 79/20* (2013.01); *E05B 81/90* (2013.01); *E05B 85/06* (2013.01); *E05B 85/10* (2013.01); *E06B 7/28* (2013.01); *E05B 85/16* (2013.01); *Y10T 70/5155* (2015.04)

(58) Field of Classification Search

CPC ..... E05B 85/10; E05B 83/36; E05B 81/90; E05B 19/0082; E05B 79/20; E05B 85/06; E05B 19/043; E06B 7/28

USPC ..... 49/460, 502; 16/412; 70/208, 210, 257, 70/396, 215, 456 R, 221; 206/37.1, 37.4, 206/37.7

See application file for complete search history.

(56) References Cited

U.S. PATENT DOCUMENTS

| | | | | |
|---|---|---|---|---|
| 4,706,478 | A * | 11/1987 | Swan et al. | 70/28 |
| 4,800,638 | A * | 1/1989 | Herringshaw et al. | 29/407.1 |
| 5,056,343 | A | 10/1991 | Kleefeldt et al. | |
| 5,058,258 | A | 10/1991 | Harvey | |
| 5,248,175 | A | 9/1993 | Burns | |

(Continued)

FOREIGN PATENT DOCUMENTS

| | | | |
|---|---|---|---|
| DE | 19620059 | A1 | 11/1997 |
| DE | 102005041551 | A1 | 3/2007 |

(Continued)

*Primary Examiner* — Gregory Strimbu

(74) *Attorney, Agent, or Firm* — Jason Rogers; Price Heneveld LLP

(57) ABSTRACT

A vehicle door includes a lock cylinder having an actuator member that is operably connected to a door latch mechanism. A door handle moves from a first or home position covering an outer end of the lock cylinder to a partially open position wherein the outer end of the lock cylinder is exposed. When the door handle is in the partially open position, a user can access the lock cylinder and insert a key into the lock cylinder to unlock the door. Thus, the lock cylinder is covered and hidden behind a portion of the door handle when the door handle is in the first position to provide an uncluttered, visually appealing appearance.

3 Claims, 9 Drawing Sheets

(56) References Cited

U.S. PATENT DOCUMENTS

| | | | | |
|---|---|---|---|---|
| 5,332,273 | A | 7/1994 | Komachi | |
| 5,369,911 | A | 12/1994 | Fortunato | |
| 5,494,322 | A | 2/1996 | Menke | |
| 5,560,659 | A | 10/1996 | Dault | |
| 5,632,516 | A | 5/1997 | Schwab | |
| 5,852,944 | A | 12/1998 | Collard, Jr. et al. | |
| 5,862,896 | A | 1/1999 | Villbrandt et al. | |
| 5,984,383 | A * | 11/1999 | Parikh et al. | 292/121 |
| 6,027,148 | A | 2/2000 | Shoemaker | |
| 6,089,626 | A | 7/2000 | Shoemaker | |
| 6,240,755 | B1 * | 6/2001 | Da Silva | 70/423 |
| 6,256,932 | B1 | 7/2001 | Jyawook et al. | |
| 6,367,124 | B1 | 4/2002 | Bella et al. | |
| 6,418,761 | B1 * | 7/2002 | Wytcherley et al. | 70/208 |
| 6,441,512 | B1 | 8/2002 | Jakel et al. | |
| 6,530,251 | B1 | 3/2003 | Dimig | |
| 6,698,262 | B2 | 3/2004 | Wittwer | |
| 6,715,806 | B2 | 4/2004 | Arlt et al. | |
| 6,779,372 | B2 | 8/2004 | Arlt et al. | |
| 6,786,070 | B1 | 9/2004 | Dimig et al. | |
| 6,825,752 | B2 | 11/2004 | Nahata et al. | |
| 6,843,085 | B2 | 1/2005 | Dimig | |
| 7,062,945 | B2 | 6/2006 | Saitoh et al. | |
| 7,070,018 | B2 | 7/2006 | Kachouh | |
| 7,270,029 | B1 | 9/2007 | Papanikolaou et al. | |
| 7,360,803 | B2 | 4/2008 | Parent et al. | |
| 7,363,788 | B2 | 4/2008 | Dimig et al. | |
| 7,387,004 | B2 * | 6/2008 | Schutz et al. | 70/215 |
| 7,446,645 | B2 | 11/2008 | Steegmann et al. | |
| 7,526,936 | B2 | 5/2009 | Niskanen et al. | |
| 7,543,863 | B2 | 6/2009 | Herbert et al. | |
| 7,642,669 | B2 | 1/2010 | Spurr | |
| 7,705,722 | B2 | 4/2010 | Shoemaker et al. | |
| 7,748,246 | B1 * | 7/2010 | Paige et al. | 70/208 |
| 7,791,218 | B2 | 9/2010 | Mekky et al. | |
| 7,810,856 | B2 | 10/2010 | Muller et al. | |
| 7,926,385 | B2 | 4/2011 | Papanikolaou et al. | |
| 8,061,169 | B2 | 11/2011 | Young | |
| 2003/0025337 | A1 | 2/2003 | Suzuki et al. | |
| 2003/0111863 | A1 | 6/2003 | Weyerstall et al. | |
| 2005/0223766 | A1 * | 10/2005 | Hashimoto et al. | 70/456 R |
| 2006/0150696 | A1 * | 7/2006 | Eychenne et al. | 70/456 R |
| 2006/0226953 | A1 * | 10/2006 | Shelley et al. | 340/5.62 |
| 2008/0021619 | A1 | 1/2008 | Steegmann et al. | |
| 2008/0190157 | A1 | 8/2008 | Mizuno | |
| 2008/0224482 | A1 | 9/2008 | Cumbo et al. | |
| 2008/0290668 | A1 * | 11/2008 | Ieda et al. | 292/198 |
| 2008/0303291 | A1 | 12/2008 | Spurr | |
| 2009/0039671 | A1 | 2/2009 | Thomas et al. | |
| 2009/0160211 | A1 | 6/2009 | Krishnan et al. | |
| 2009/0205383 | A1 * | 8/2009 | Katagiri et al. | 70/237 |
| 2009/0309971 | A1 | 12/2009 | Schuetz | |
| 2010/0007463 | A1 | 1/2010 | Dingman et al. | |
| 2010/0162777 | A1 | 7/2010 | Savant | |
| 2010/0235057 | A1 | 9/2010 | Papanikolaou et al. | |
| 2010/0235058 | A1 | 9/2010 | Papanikolaou et al. | |
| 2010/0235059 | A1 | 9/2010 | Krishnan et al. | |
| 2010/0293753 | A1 | 11/2010 | Saitou et al. | |
| 2010/0326149 | A1 | 12/2010 | Chang et al. | |
| 2012/0119524 | A1 | 5/2012 | Bingle et al. | |
| 2012/0137743 | A1 * | 6/2012 | Katagiri et al. | 70/215 |
| 2012/0228886 | A1 | 9/2012 | Muller et al. | |

FOREIGN PATENT DOCUMENTS

| | | |
|---|---|---|
| EP | 1403453 | 3/2004 |
| JP | 11241532 | 9/1999 |
| JP | 2007321470 | 12/2007 |

* cited by examiner

SEAMLESS EXTERIOR HANDLE FOR A VEHICLE DOOR

FIELD OF THE INVENTION

The present invention generally relates to door handles for vehicles, and in particular a seamless (or continuous) exterior door handle without a separate bezel or keyhole as is the case with current handle designs.

BACKGROUND OF THE INVENTION

Various exterior door handles for motor vehicles have been developed. A known type of design includes a separate bezel and an exposed lock cylinder that receives a key for rotation of the lock cylinder. However, known exterior door handle designs suffer from various drawbacks. For example, an exposed keyhole is required to provide access to the lock cylinder, and this may degrade the appearance of the vehicle. Known handle designs utilize a fixed bezel with a keyhole, features that are not required according to the present invention. Remotely actuated power door locks have become a standard feature on many vehicles. Thus, lock cylinders are typically used under a low battery or power loss situation in which the remote lock feature fails to operate.

SUMMARY OF THE INVENTION

One aspect of the present invention is a door for motor vehicles including a door structure having inner and outer sides, an outer perimeter, and an interior space. The outer side of the door includes a generally smooth outer surface defining a surface contour. The door further includes a latch mechanism that is adapted to selectively retain the door in a closed position when the door is mounted to a vehicle. The door also includes a lock cylinder assembly having an outer end. The outer end has an opening that is configured to receive a key to unlock the door. The outer end is disposed on the outer side of the door, and the lock cylinder has an inner end disposed in the interior space. The inner end has an actuator member that is operably connected to the door latch to operate the door latch via a cable or other suitable arrangement to operate the door latch such that the rotational motion of the key during locking/unlocking is transferred to linear motion of the cable via the bell crank (inward end of the lock cylinder). The door still further includes a handle that is movably connected to the door structure for movement from a first position wherein a portion of the handle completely covers the outer end of the lock cylinder to an open position wherein the outer end of the lock cylinder is exposed to permit a key to be inserted into the space between the partially open handle and the outer face of the lock cylinder. The handle is seamless (continuous) and it does not use a fixed bezel with a keyhole as is the case on current handle designs. The covered lock cylinder arrangement potentially provides for a more pleasing and refined appearance, improved aerodynamics, and reduced windnoise. The covered lock cylinder arrangement also protects the lock cylinder from environmental degradation and loss of function.

Another aspect of the present invention is a folding emergency extended length key that is required to reach the hidden lock (current key designs will not work) such that it can double its length by unfolding when needed to be used to unlock the vehicle manually using this key. Yet another aspect of the present invention is a keyfob that is designed to securely store/retain a folding emergency key with a sliding cover, a brand logo with illumination upon locking or unlocking to indicate the lock state of the vehicle directly on the fob (instead of having to look at the vehicle). This is possible when the customer is within a range of current keyfob ranges e.g. 30-50 feet. The lock state may be displayed on the fob. Current passive and remote keyfobs do not offer this feature. The only way to verify if the vehicle is locked is by activating the fob lock button again or viewing the lock state indication (if any) on the inside of the door.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
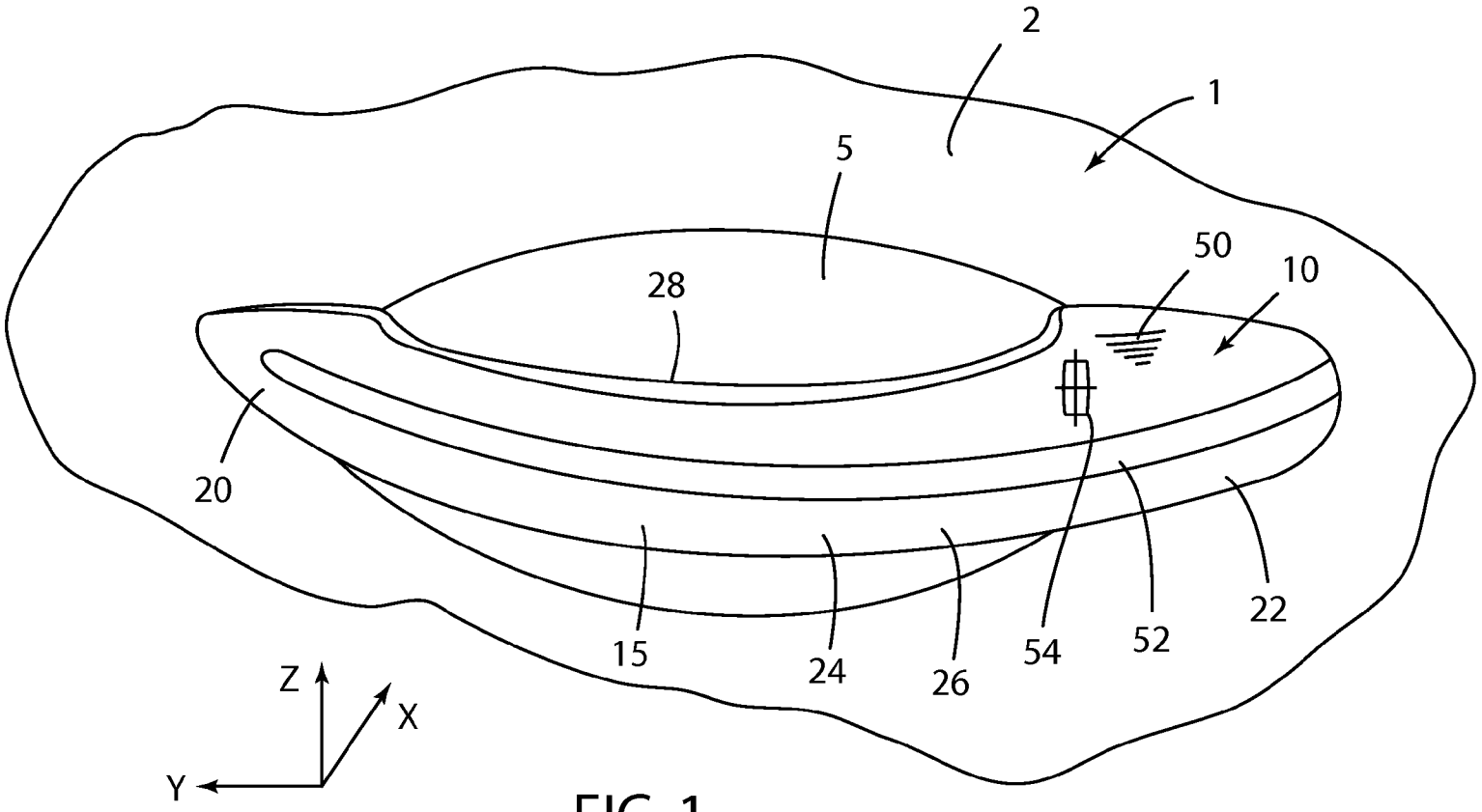
FIG. 1 is a partially fragmentary isometric view of a door handle according to one aspect of the present invention.
Figure 2:
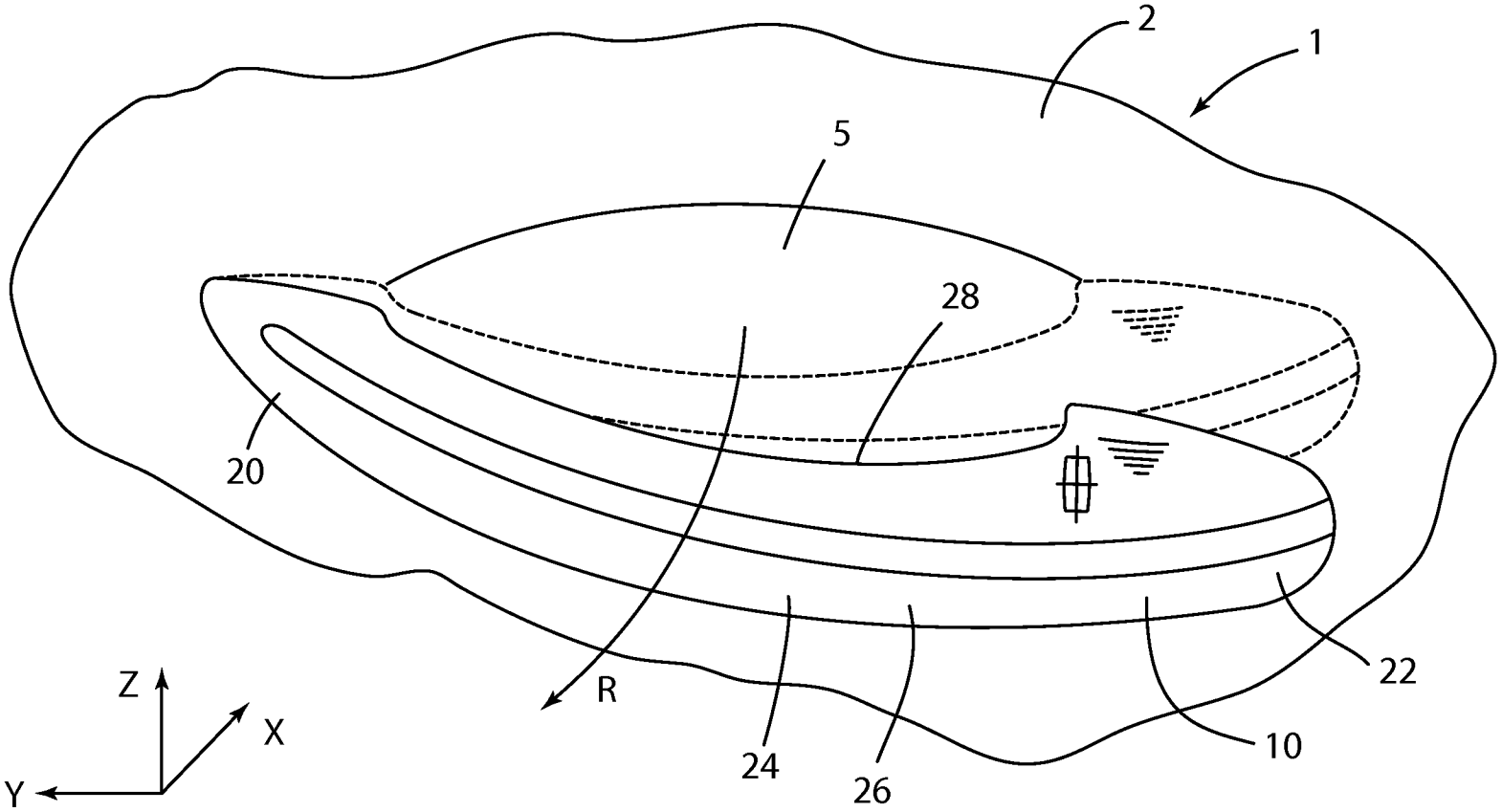
FIG. 2 is a partially fragmentary isometric view of the door handle of FIG. 1 in a partially open position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle door 1 according to one aspect of the present invention includes a handle assembly 10 that is disposed adjacent, or in contact with, exterior surface 2 of vehicle door 1. Exterior surface 2 may be a "class A" surface that is painted or otherwise finished to provide a finished appearance. The exterior surface 2 may comprise a layer of sheet metal, composite material, or other suitable material that is painted according to known methods. A pocket or depression 5 is formed in the exterior surface 2. The pocket or depression 5 may also be painted or otherwise finished, and it may be stamped or formed by other known processes. Significantly, according to the present invention, no separate bezel or exposed keyhole are present.

Figure 3:
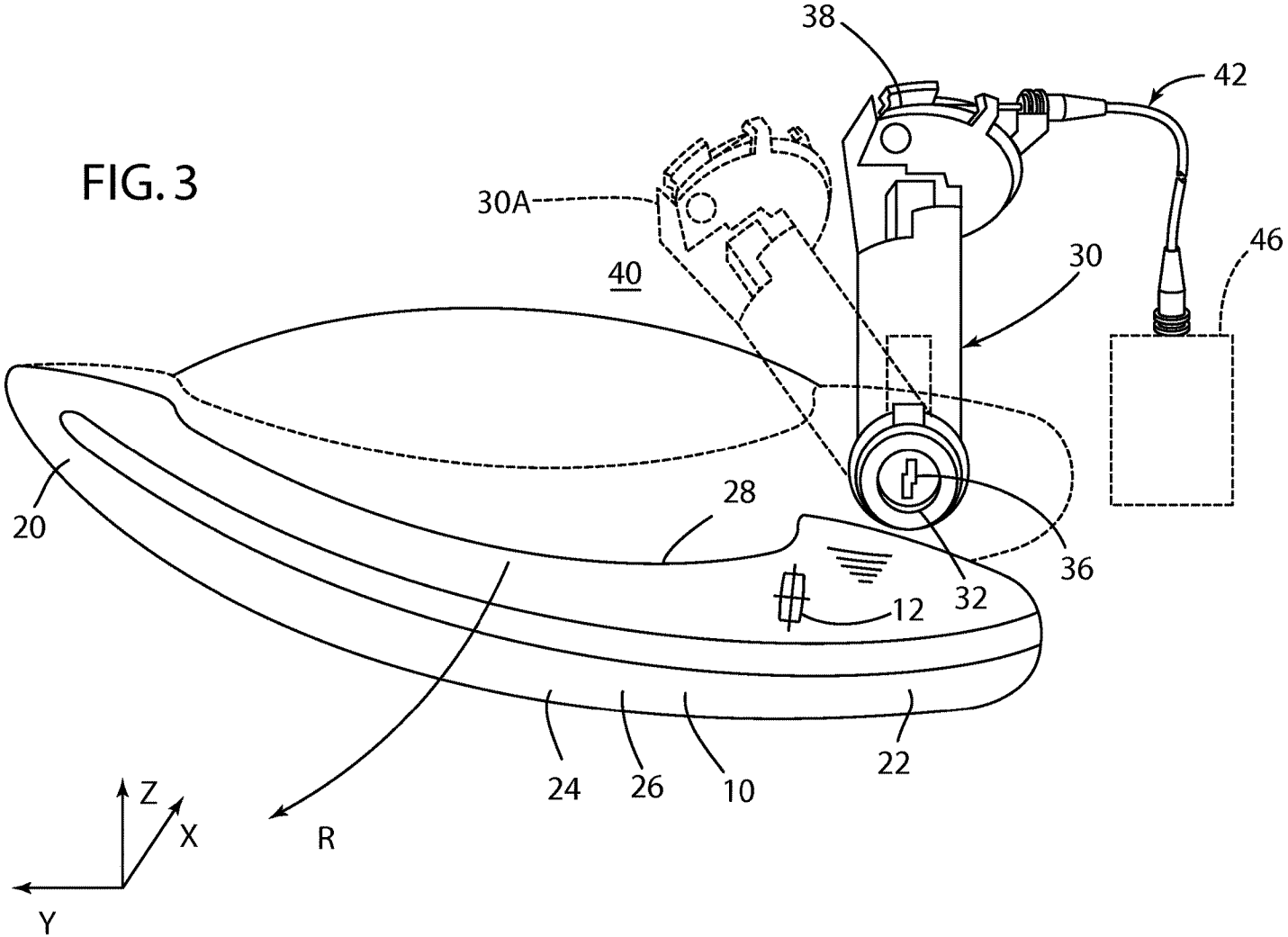
FIG. 3 is a partially fragmentary isometric view of the door handle of FIG. 1 in a fully open position wherein the lock cylinder is exposed for use by insertion of a key.
Figure 3A:
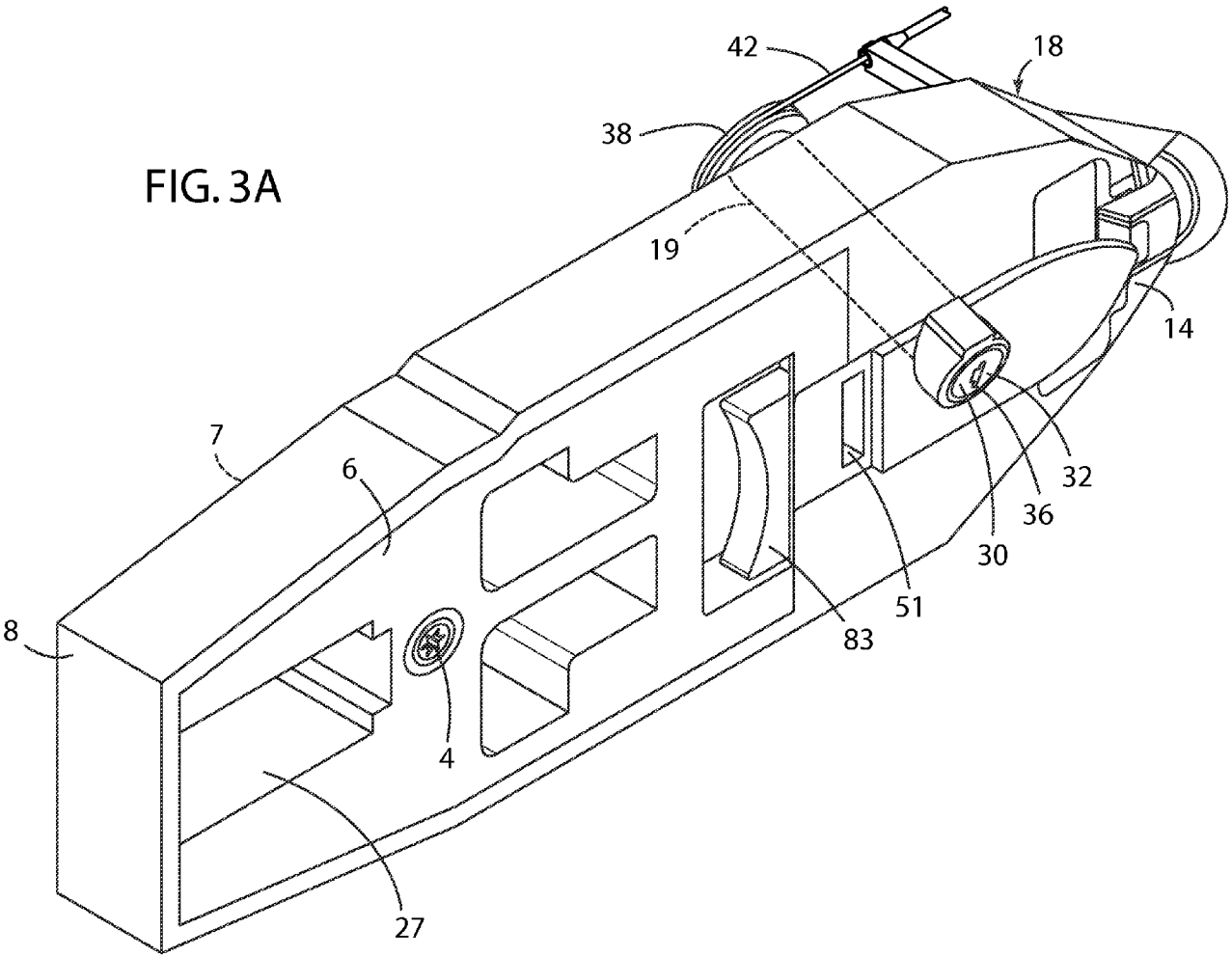
FIG. 3A is an isometric view of a chassis of the door handle of FIG. 1.
Figure 4:
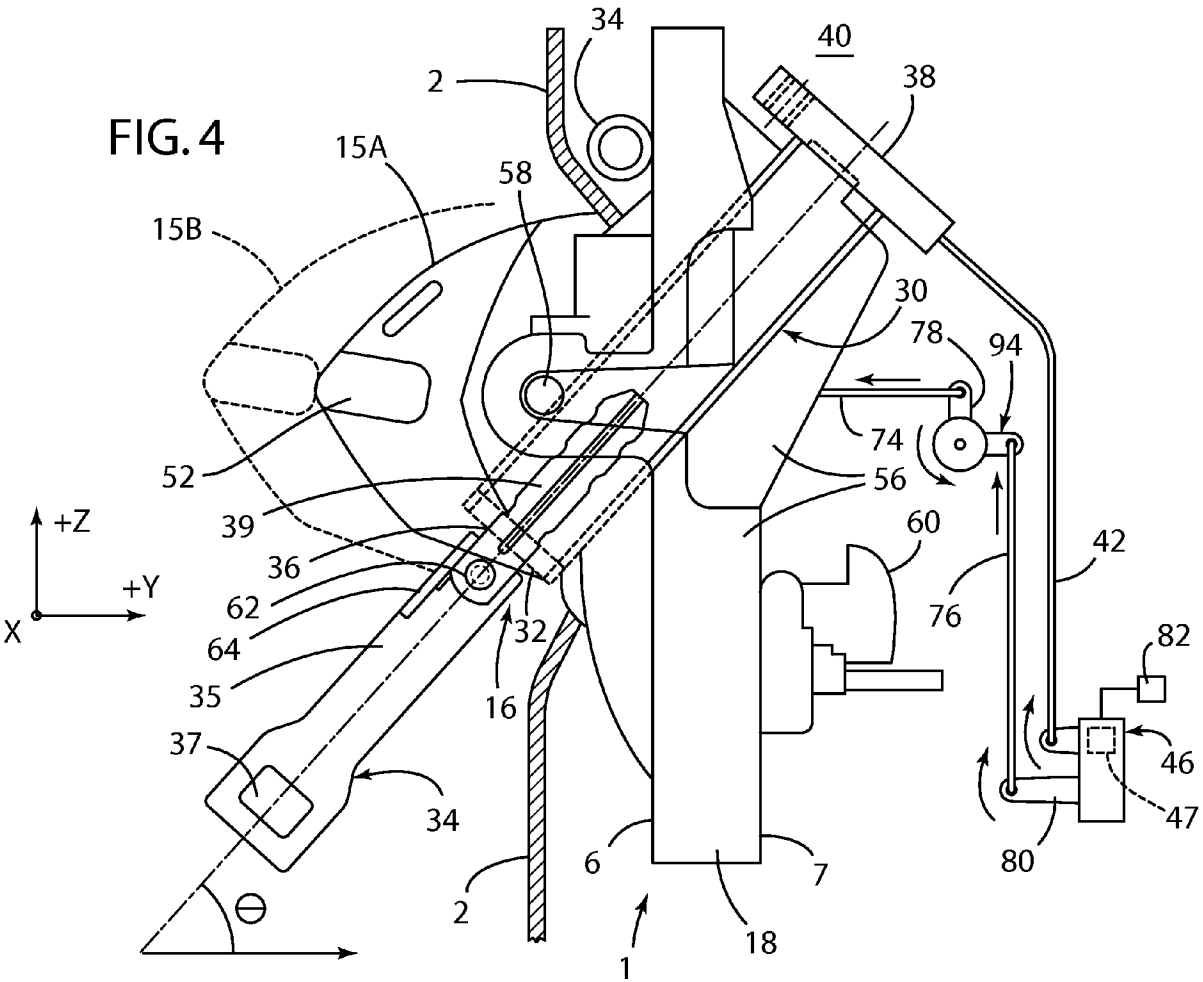
FIG. 4 is a vertical section view of the door handle through the center of the key cylinder as viewed from the rear end of the door handle of FIG. 1.
Figure 5:
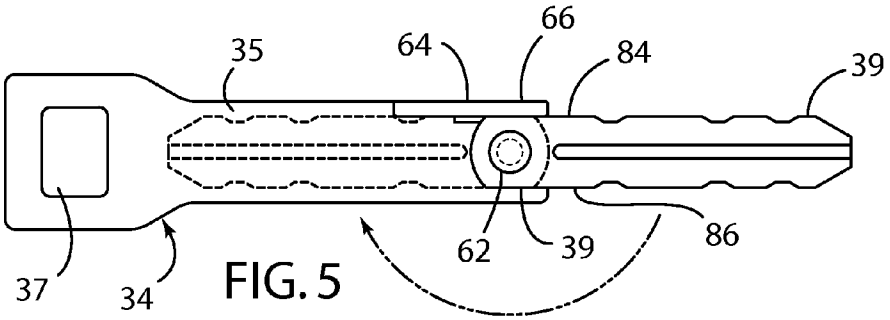
FIG. 5 is a top plan view of a folding key according to one aspect of the present invention.
Figure 6:
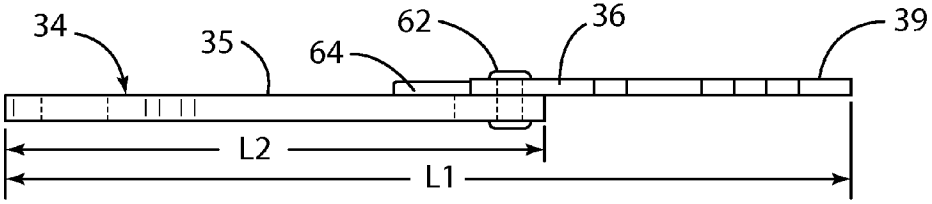
FIG. 6 is a front elevational view of the folding key.
Figure 7:
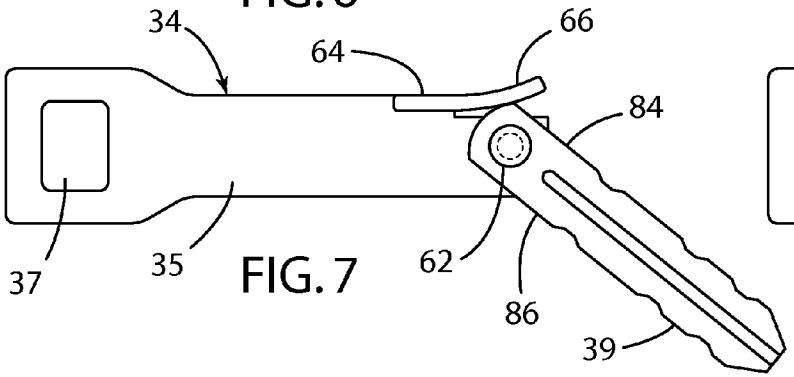
FIG. 7 is a plan view of the folding key in a partially folded condition.

The handle assembly 10 includes a seamless continuous handle member 15 that is rotatably or pivotably connected to a door structure such as chassis 18 (see also FIGS. 3A and 4) for rotation about a generally vertical axis Z (in vehicle coordinates) as shown by the arrow "R." As discussed in more detail below, chassis 18 accommodates a hidden lock cylinder 30 that extends both upwardly and forwardly to permit user access to outer end 32 (also called a lock shutface) of lock cylinder 30. A remote (powered) door lock is normally utilized to unlock latch mechanism 46 (FIG. 4). However, lock cylinder 30 can be accessed to manually unlock latch mechanism 46 in the event the remote (powered) door lock feature fails. The present invention includes a seamless (continuous) handle member 15 that does not include a fixed bezel with a keyhole as is the case in current handle designs. Handle member 15 generally includes a front or forward end 20, a rear or rearward end 22, and an elongated central portion 24 extending between the forward end 20 and the rearward end 22. The elongated central portion 24 has a compound convex outer surface 26, and a smoothly curved concave inner surface 28 configured to be grasped by a user. The central portion 24 generally extends in a fore-aft direction when the handle member 15 is in the closed position as shown in FIG. 1. When handle member 10 is in the fully closed position of FIG. 1, the handle member 10 completely covers and hides lock cylinder 30 (FIG. 3). Significantly, handle member 15 is continuous or seamless. In other words, in contrast to known handle designs, there is no split line between the handle and a fixed bezel or cap, and there is also no externally exposed keyhole when handle member 15 is in the closed position.

With further reference to FIG. 4, handle member 15 is operably connected to latch mechanism 46 by linkage 94. Latch mechanism 46 may comprise a conventional mechanism of a type that is well-known in the art. Specifically, latch mechanism 46 may include a rotatable ratchet (not shown) that selectively engages a striker (not shown) mounted on the vehicle body. A movable pawl (not shown) selectively engages the ratchet and prevents the ratchet from rotating to a released position. Thus, when the pawl is in an engaged position, the ratchet cannot be rotated to a released position to permit disengagement of the ratchet from the striker. However, when the pawl is in a disengaged position, the ratchet can rotate to a released position and disengage from the striker to thereby permit the vehicle door 1 to be opened. Movement of lever 80 causes the pawl to move between its engaged and disengaged positions. Latch mechanism 46 includes a lock feature or mechanism that is also known as a bypass mechanism. The lock can be shifted from a locked state to an unlocked state by powered actuation or by actuation of lock cylinder 30. When the lock is in an unlocked state, outward rotation of handle member 15 shifts linkage 94, causing the pawl to shift to a released position, thereby permitting the ratchet to rotate and release from the striker to permit vehicle door 1 to open. However, when the lock is in a locked state, outward rotation of handle member 15 does not cause the pawl to shift to a released position. Thus, when the lock is in a locked state, outward movement of handle member 15 causes linkage 94 to move lever 80, but movement of lever 80 does not move the pawl, and the pawl continues to retain the ratchet in an engaged position with the striker such that the vehicle door 1 cannot be opened. It will be understood that the lock feature may be integral to latch mechanism 46, or it may comprise a separate mechanism. In general, virtually any type of lock mechanism or feature may be utilized to selectively disable handle member 15 such that handle member 15 cannot be used to release latch mechanism 46. Linkage 94 may comprise rods, cables, or other suitable components. For example, linkage 94 may comprise connecting members such as rods 74 and 76 (which can alternately comprise one or more cables), and a bell crank 78. In the illustrated example, bell crank 78 may be part of the chassis 18 and it is rotationally biased by a spring (not shown) about a metal pivot pin. The pivot pin may be secured to the handle chassis 18 utilizing a fastener or the like. The bell crank 78 is not the focus of this invention, and the details concerning how it attaches to the handle chassis 18 have therefore not been shown. It will be understood that virtually any type of suitable linkage arrangement may be utilized to operably interconnect handle member 15 to latch mechanism 46.

As discussed in more detail below, during normal operation (i.e. the vehicle has power and powered actuator 47 is operable) a user utilizes a remote key fob 72 (FIGS. 9-11) or a keyless entry system to power unlock the latch mechanism 46 via powered actuator 47. After unlocking latch mechanism 46, the user then pulls handle member 15 to the fully opened position to mechanically unlatch the door latch mechanism 46 due to movement of elongated connecting members 74 and 76 (which can be a rod or a single cable).

However, lock cylinder 30 can be accessed if vehicle power is lost and/or powered actuator 47 malfunctions, or if an emergency occurs. To access lock cylinder 30, handle member 15 can be rotated from a rest position designated "15A" to a partially opened position "15B." This forms a temporary opening or gap 16 between partially opened handle member 15B and front or outer end 32 (shutface) of lock cylinder 30. If latch mechanism 46 is unlocked, further outward rotation of the handle member 15 shifts elongated connector 74 outwardly, which thereby rotates bell crank 78. This, in turn, causes the elongated connecting member 76 (rod or cable) to shift linearly, thereby actuating lever 80 to unlatch door latch mechanism 46. However, if latch mechanism 46 is locked, further outward rotation of handle member 15 from the partially opened position 15B does not cause the latch mechanism to release, such that door 1 cannot be opened. If latch mechanism 46 cannot be unlocked using powered actuator 47 due to a vehicle loss of power or other malfunction, handle member 15 can be shifted to the partially opened position 15B to expose outer end 32 of lock cylinder 30. End 39 of key 34 can then be inserted into lock cylinder 30 and rotated to thereby mechanically unlock latch mechanism 46 due to movement of a mechanical connector 42.

Lock cylinder 30 is preferably mounted at an accessible angle to provide for ergonomic use thereof in the event powered actuator 47 cannot be used to unlock latch mechanism 46. In the illustrated example, the lock cylinder 30 is positioned at an angle θ (FIG. 4) of about 45° relative to the Z-axis. For example, the lock cylinder 30 may be angled forward between the X and Y-axes as shown by the dashed line 30A (FIG. 3), such that lock cylinder 30 forms a compound angle relative to the vehicle X, Y and Z axis. Although various angles could be utilized, in the illustrated example the lock cylinder 30 is angled at about 45° relative to the X and Y-axes. In general, the orientation of the lock cylinder is selected to maximize ergonomics/ease of use, and the orientation may therefore vary depending on the geometry and height of handle member 15 and other such factors. Inner end 38 of lock cylinder 30 is disposed behind exterior surface or outer door skin 2 in an interior space 40 of door 1. The term "interior space" as used herein merely designates an area that is behind or inward of the front or outer end 32 of lock cylinder 30, or inboard of the outer skin or surface 2. An elongated connector 42 (FIG. 3) mechanically connects inner end (bell crank 38) of lock cylinder 30 to a door latch mechanism 46. Connector 42 may comprise a cable, a rod or other suitable connector. Various types of suitable cables and rods for interconnecting a lock cylinder to a door latch are known, and the details of connector 42 will not, therefore, be described in detail.

Cable 42 operably interconnects the lock cylinder 30 to the vehicle door latch mechanism 46, such that rotation of lock cylinder 30 upon insertion of end 39 of key 34 causes the lock feature/mechanism of door latch mechanism 46 to unlock. The rotational movement of the key 34 (upon insertion into the lock cylinder 30) causes the innermost portion (bell crank 38) of the lock cylinder 30 to rotate, and bell crank 38 transfers the rotational movement into linear movement of the cable or rod 42 as shown in FIGS. 3, 3A, and 4.

Referring again to FIG. 4, movement of handle member 15 from the rest position 15A to the partially opened position 15B creates a gap 16 between rearward end 22 of handle 15 and the outer end 32 of lock cylinder 30. A user can then insert the end 39 of key 34 into opening 36 at outer end 32 of lock cylinder 30. The end 39 of key 34 is extra long to facilitate access to lock cylinder 30.

Figure 8:
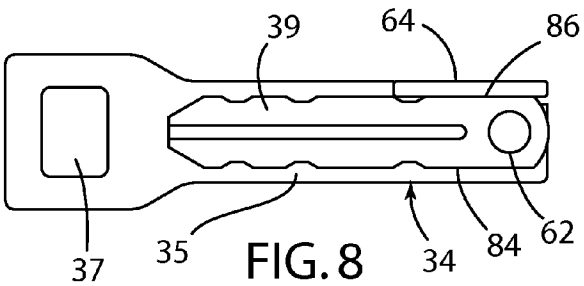
FIG. 8 is a plan view of the folding key in a fully folded condition.

With further reference to FIGS. 5-8, key 34 includes a base 35 and an end 39 that is pivotably connected to the base 35 at a pivot 62. End 39 rotates relative to base 35 between a deployed position (FIG. 5) and a folded position (FIG. 8). Pivot 62 may comprise a pressed pin, a rivet-type connection, or other suitable arrangement. The overall length of L1 (FIG. 6) is about 110 mm to about 120 mm, and the length of the base L2 is about 70 mm to about 80 mm. The base 35 includes a stop or lock 64 in the form of a flexible tab 66. The stop or lock 64 prevents rotation of end 39 relative to base 35 beyond the 180° fully-deployed position shown in FIG. 5. The pivot connection 62 is preferably a relatively high friction connector whereby the end 39 tends to stay at a selected angular position relative to the base 35. The flexible tab 66 contacts the edge 84 of base 35 when the key is in the fully deployed (180 degrees) configuration shown in FIG. 5. The tab 66 contacts the edge surface 86 of end 39 when in the folded or retracted position of FIG. 8. The stop 64 retains the end 49 in either the fully deployed position of FIG. 5 or the fully folded position of FIG. 8. In a preferred embodiment the base 35 is made of a molded polymeric material having sufficient flexibility to permit flexing of the tab 66, and the end 39 is made of steel or other suitable material. End 39 may comprise a blade having specific edge shapes that are configured to engage the internal mechanism (not shown) of lock cylinder 30 in a known manner. Base 35 and end 39 of key 34 may also be slidably or telescopically interconnected to permit key 34 to shift between retracted and deployed configurations. Base 35 may include an opening 37 that may be utilized to connect the key 34 to a key chain or the like.

Figure 10:
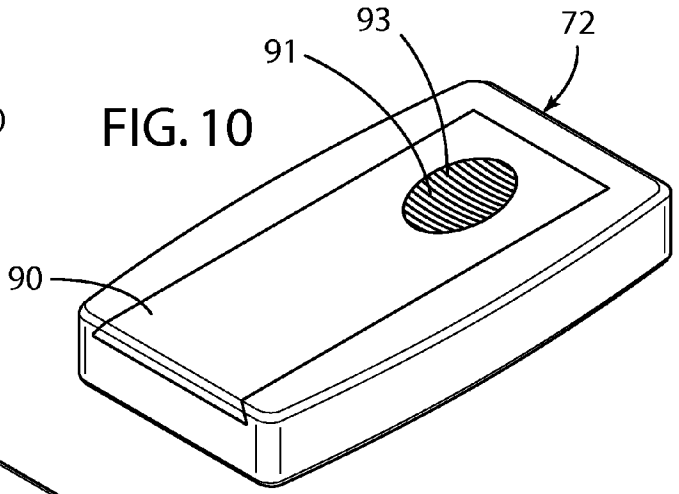
FIG. 10 is an isometric view of a keyfob of FIG. 9.
Figure 9:
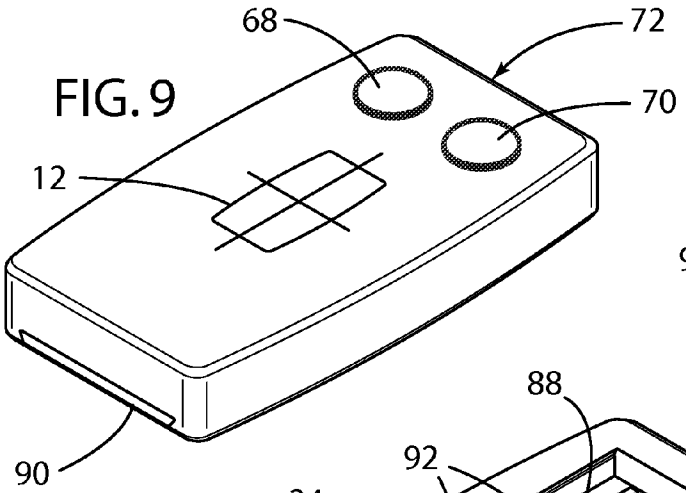
FIG. 9 is an isometric view of a keyfob for storing the folding key.
Figure 11:
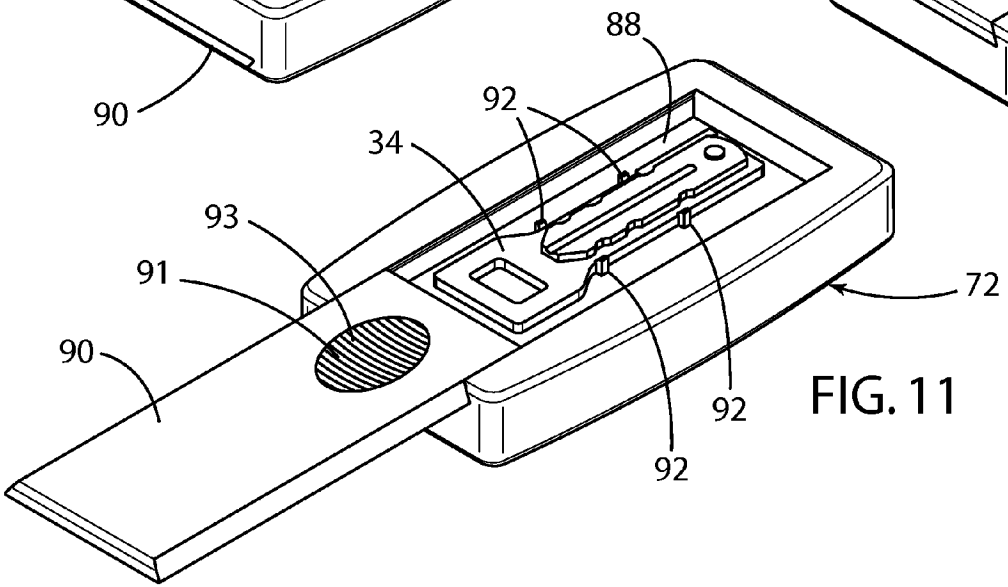
FIG. 11 is an isometric view of the keyfob with a sliding door in an open position.

With further reference to FIGS. 9-11, key 34 may be stored in a cavity 88 of a keyfob 72. Keyfob 72 includes a slideable door or cover 90 that can be shifted from an open position (FIG. 11) to a closed position (FIG. 10). Cover 90 may include a shallow concave depression 91 forming a thumb/finger detent. Detent/depression 91 may include a plurality of raised ridges 93 to improve a user's grip. Fob 72 may include a plurality of barbed posts 92 that receive and retain key 34 in cavity 88. Keyfob 72 may include pushbuttons 68 and 70 for remote locking/unlocking of the vehicle latch mechanism 46 utilizing powered actuator 47. Pushbuttons 68 and 70 may be operably connected to a transmitter (not shown) of a known type that is disposed inside of keyfob 72. Fob 72 may also include a brand logo 12 or the like to identify the make of the vehicle.

Referring again to FIG. 1, the door 1 may include a Passive Entry Passive Start ("PEPS") system including a sensor 50 mounted on handle member 15. The sensor 50 senses the presence of keyfob 72 (FIGS. 9-11) and determines if the keyfob is authorized. Sensor 50 may comprise an antenna that receives signals from fob 72, and sensor 50 may further include a proximity sensor that senses if a user's hand is within a predefined distance of the handle member 15. The PEPS system may be substantially the same as the PEPS system described in U.S. Pat. No. 8,701,353, the entire contents of which are incorporated by reference. Although the PEPS system/sensor 50 is an optional feature, it may comprise the primary way in which door latch mechanism 46 is unlatched. Thus, lock cylinder 30 may be utilized as a manual backup in case the sensor 50 or other electrical components experience a failure due to a power loss or the like.

Handle member 15 may include an elongated chrome strip 52 that is illuminated by LEDs (not shown) disposed behind the chrome strip 52. Also, a lock state indicator such as an LED or other illuminated symbol 54 forms a lock state indicator that may be utilized to indicate the lock state or condition. For example, the light 54 may illuminate if the vehicle is unlocked, thereby signaling to a user that the sensor 50 has detected the presence of an authorized user. Light 54 may be configured to illuminate for a predetermined period of time (e.g. 10 seconds) then fade out. Strip 52 may also be selectively illuminated to provide a lock state indication. The light 54 and/or strip 52 may be illuminated when a user presses a button 68 and/or 70 on keyfob 72 or if sensor 50 determines that an authorized keyfob 72 is present and/or that a user's hand is within a predefined distance of handle member 15. The indicia or brand logo 12 of keyfob 72 may also comprise a light (e.g. LED) that is selectively illuminated to show the lock state based on the same input criteria as strip 52 and/or light 54. The light 54 may comprise a vehicle brand symbol or logo, an image of a padlock, or other appropriate indicia. An audio signal may also be produced when the lock is unlocked to alert a user of the state of the lock.

Figure 3B:
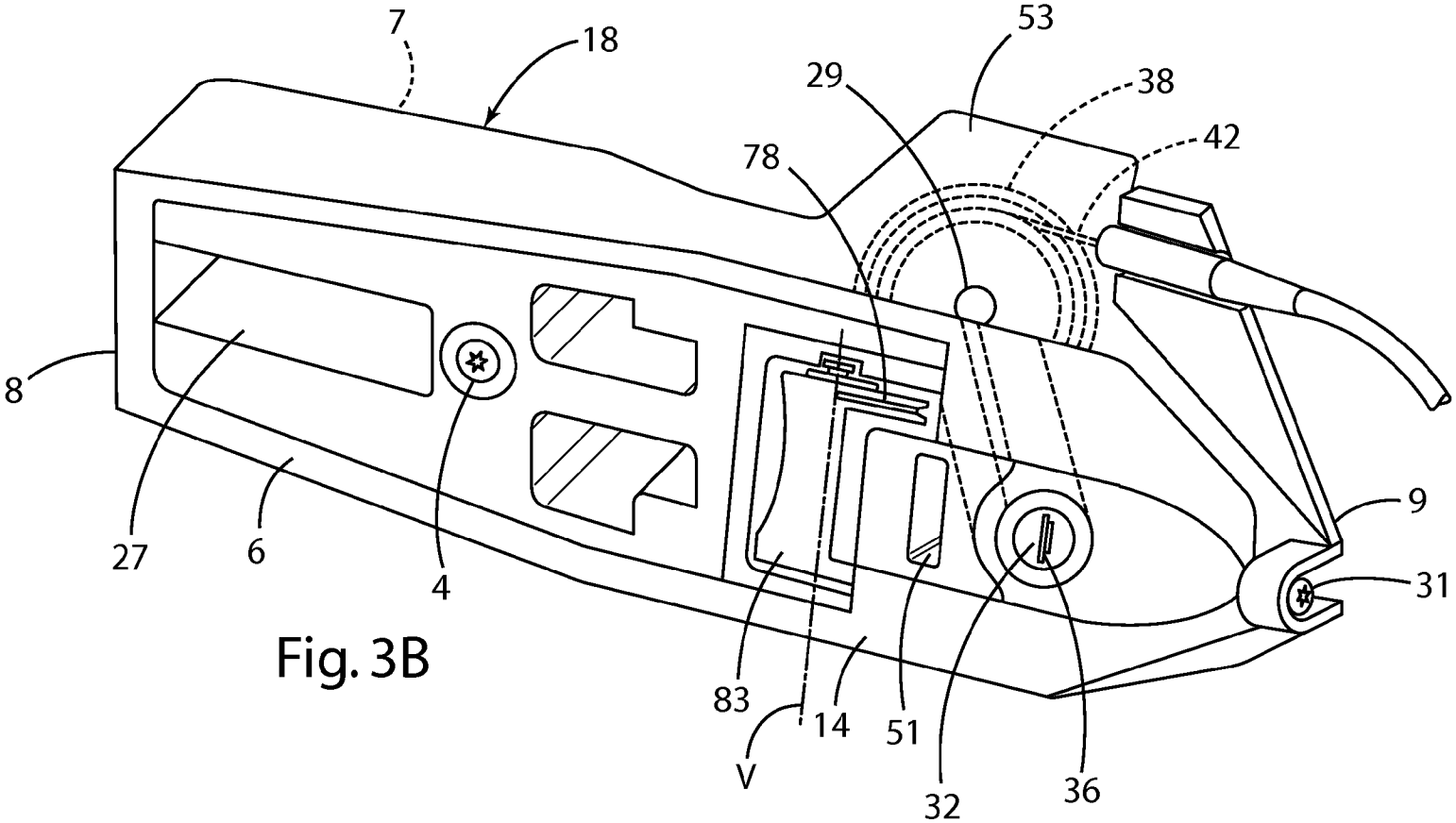
FIG. 3B is an isometric view of a chassis of the door handle of FIG. 1.
Figure 3C:
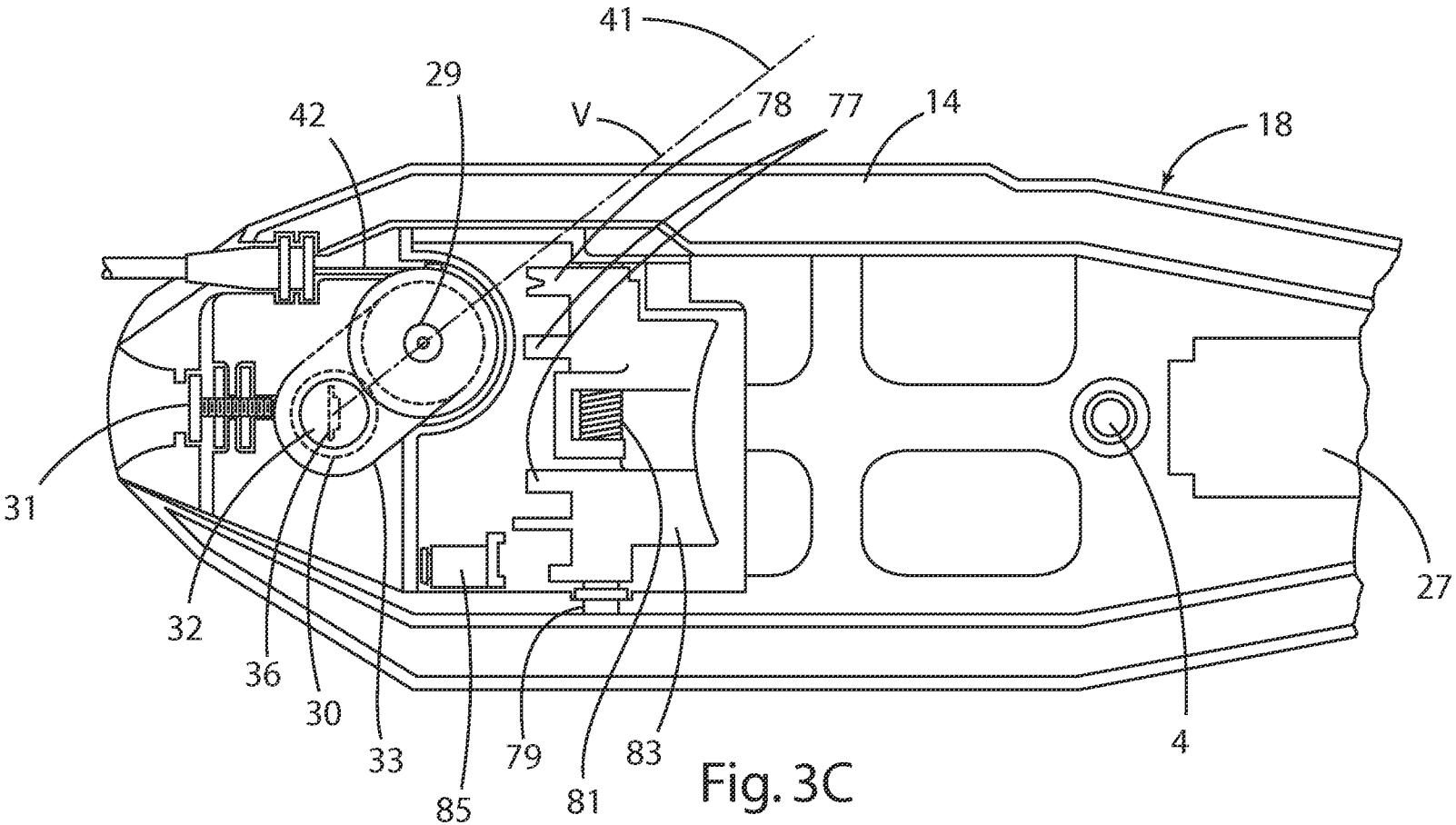
FIG. 3C is a partially fragmentary view of a chassis of the door handle of FIG. 1.

FIGS. 3A, 3B, 3C and 4, show a structural member 18 of the handle assembly known as the chassis, and chassis side attachment fasteners 58. Chassis 18 supports the hidden lock cylinder 30 in an angled manner that is unique relative to existing handle chassis. Chassis 18 may include a variety of mounting features/structures as required for a particular application. Chassis 18 (FIG. 3A) includes a body 14 formed of polymer or other suitable material. Body 14 includes an outer side 6, an inner side 7, a front end portion 8, and a rear end portion 9. When installed, chassis 18 is disposed inwardly of outer door skin 2 of door 1, with outer side 6 of chassis 18 facing outer door skin 2. Threaded fasteners 4 or other suitable fasteners are utilized to secure chassis 18 to the door 1. One or more mounting/locating features such as hooks (not shown) can be utilized in conjunction with threaded fasteners 4 to secure chassis 18 to the vehicle door. In general, outer face 6 of chassis 18 may be configured to contact the inner surface of outer door skin 2 (FIG. 4), and a bezel core (not shown) may be disposed against an outside surface of outer door skin 2, and threaded fasteners 4 may be utilized to secure the chassis 18 to the bezel core with the outer door skin 2 sandwiched between the bezel core and the chassis 18. The bezel core, hooks, and fasteners utilized to secure chassis 18 to the outer door skin 2 may be substantially similar to known handle securing arrangements, and these features are not therefore described in detail. A threaded fastener 31 secures the lock cylinder 30 to the chassis 18. With reference to FIG. 3C, lock cage 33 is formed integrally with chassis 18, and forms a compound angle with respect to the X and Y axes of the vehicle. The axis 41 of lock cylinder 30 is disposed at a compound angle with respect to the vehicle X and Y axes. For example, the lock cylinder 30 may be disposed at a 45° angle with respect to the vehicle Y and Z axes, and at 135° with respect to the vehicle X axis.

Referring again to FIG. 3C, bell crank 78 is pivotably mounted to the chassis 18 by a bell crank pin 79. A torsion spring 81 and counter balance 83 counter balance inertial forces generated by the other components in the event the vehicle experiences lateral acceleration. These components may be substantially similar to existing counter balance arrangements that are known in the art, and these features are therefore not described in detail herein. An inertia lock 85 may be utilized to prevent inadvertent opening of the handle member 15, and may comprise a known inertia lock. In general, the bell crank 78 and counter balance 83 may comprise an integral, one-piece unit. The unit may further include a handle capture feature 77 that may be substantially similar to known units. The lock cylinder 30 includes a lock cylinder shaft 29 that is operably connected to the bell crank 38 at the inner end of lock cylinder 30. In general, the bell crank 38 converts rotary motion of lock cylinder shaft 29 into linear motion of rod or cable 42 in a known manner.

A channel 51 in chassis 18 provides clearance for the handle rear arm or plunger. The chassis 18 also includes a channel or slot 27 that provides clearance for the forward pivot arm of the handle 10. With reference to FIG. 3B, chassis 18 may include a flange or theft shield 53 that extends upwardly from the main body of chassis 18 to protect the inner end or bell crank 38 of lock cylinder 30.

Significantly, chassis 18 includes an angled bore 19 that receives lock cylinder 30 at an angle such that a user can gain access to outer end 32 of lock cylinder 30 for insertion of key 34. Lock cylinder 30 is preferably angled upwardly at an angle θ (FIG. 4) of at least about 10° and more preferably about 45°. Lock cylinder 30 is also preferably angled forwardly at an angle of about 45° relative to the X and Y-axes. The handle assembly 10 may also include an inertia lock 60 to prevent opening of handle assembly 10 if the vehicle is experiencing acceleration in a sideways lateral direction (i.e. in the direction of the Y-axis; FIG. 4) due to a side impact on the vehicle. Inertia locks are known in the art, and the details of inertia lock 60 will not therefore be described in detail herein. It will be understood that the chassis 18 may have a wide range of constructions as required for a particular application and the structure or chassis 18 is not limited to the specific structure shown in FIGS. 3A, 3B, 3C, and 4. Also, the handle member 15 may be mounted for rotation about the X or the Y-axis, or a combination of rotations about the X, Y, and/or Z-axes.

Referring again to FIG. 1, in use a user approaches the vehicle door 1 with the handle assembly 10 in a closed configuration as shown in FIG. 1. During normal operation, the sensor 50 verifies that the keyfob 72 is that of an authorized user. The vehicle controller 82 (FIG. 4) then illuminates light 54, and causes the door latch 46 to power unlock utilizing powered actuator 47. As discussed above, the sensor 50 may include a proximity sensor whereby the vehicle controller does not unlock the vehicle door latch 46 unless a user's hand is within a specified distance of sensor 50. Also, at night the chrome strip 52 may be illuminated upon receiving a signal from an authorized keyfob 72 to light up and guide a user towards the door handle. A user can also utilize keyless entry keyfob 72 to remotely actuate powered actuator 47 to unlock latch 46. The user can then pull the door handle member 15 to the open position (FIG. 3), thereby unlatching the door latch 46 due to movement of linkage 94. The user then releases the handle 10, and a spring (not shown) returns the handle to the fully closed position shown in FIG. 1, and the user then enters the vehicle. The vehicle then determines if the keyfob 72 is that of an authorized user, and starts the vehicle's engine if the proper authorization conditions are met.

In the event the user approaches the vehicle and the sensor 50 does not unlock the latch 46 due to a power failure or other problem, the symbol 54 will not light up, thereby alerting the user that the vehicle door has not been unlocked. The user can then grasp the handle member 15 and rotate it to the partially opened position 15B (FIG. 4), thereby gaining access to the lock cylinder 30. A user then extends the end 39 of the key 34 and inserts it into the opening 36 of lock cylinder 30. The key 34 is then rotated to shift rod or cable 42 to mechanically unlock the door latch 46. The user can then pull the handle member 15 into the fully open position of FIG. 3, thereby unlatching the door latch 46.

The door handle of the present invention is seamless in that it does not incorporate a separate bezel (as is the case with current handle designs). The door handle of the present invention also has no exposed keyhole (as is the case with current handle designs). The door handle of the present invention can be utilized on a wide range of vehicles. Furthermore, the door handle can be configured to provide a pleasing visual appearance that is also aerodynamic. This is because there is no margin between the handle and a fixed bezel as is the case with current handle designs, and also because there is no exposed keyhole. This in turn reduces the air-leakage and associated windnoise generated by up to 50% compared to current designs which have a keyhole and a margin between the handle and a fixed bezel. This is one of the key advantages of a seamless handle with hidden lock according to the present invention, which does not include a keyhole or margin between the handle and the bezel. Because the lock cylinder 30 is hidden behind the handle member 15 when the handle member 15 is in the closed position, the lock cylinder 30 is not normally visible and there is no exposed keyhole (as is the case on current handle designs which incorporate a fixed separate bezel).

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door comprising:

a door structure having an outer side having an outer surface;

a releasable latch mechanism connected to the door structure;

a lock mechanism connected to the door structure;

a handle member having a rear end portion;

a lock assembly connected to the door structure, the lock assembly comprising a lock cylinder having an outer end, the outer end having an opening configured to receive a key to actuate the lock assembly, wherein the outer end is disposed on the outer side of the door structure, and wherein the lock assembly is operably connected to the lock mechanism such that actuation of the lock assembly causes the lock mechanism to shift from a locked state to an unlocked state;

wherein the handle member is pivotably connected to the door structure at a forward end portion of the handle member for outward movement relative to the outer side of the door structure about a generally vertical pivot axis from a closed position wherein the rear end portion of the handle member covers the outer end of the lock cylinder such that the outer end of the lock cylinder is not visible to an open position wherein the outer end of the lock cylinder is exposed, and wherein a central portion of the handle member is spaced apart from the outer surface of the door structure to define a gap to provide a clearance between the central portion of the handle member and the outer surface of the door structure permitting a user to insert a portion of a hand into the gap and grasp the handle member when the handle member is in the closed position and to manually move the handle member from the closed position to the open position;

and wherein the door structure includes front and rear portions, a horizontal fore-aft axis extending between the front and rear portions, and a horizontal lateral axis that is perpendicular to the generally vertical pivot axis and the horizontal fore-aft axis; and the lock cylinder defining a longitudinal axis that is angled forward toward the forward end portion of the handle member at an obtuse angle relative to the horizontal fore-aft axis.

2. The vehicle door of claim 1, wherein:

the axis of the lock cylinder extends at an angle of about ten degrees relative to the horizontal lateral axis.

3. The vehicle door of claim 1, wherein:

the axis of the lock cylinder extends at an angle of about forty five degrees relative to the horizontal lateral axis.

* * * * *